US006098230A

United States Patent [19]

Zseng

[11] Patent Number: 6,098,230

[45] Date of Patent: Aug. 8, 2000

[54] TOOTHBRUSH

[76] Inventor: Chun-Lin Zseng, P.O. Box 82-144, Taipei, Taiwan

[21] Appl. No.: 09/290,194

[22] Filed: Apr. 13, 1999

[51] Int. Cl.[7] ..... A46B 13/08

[52] U.S. Cl. ..... 15/22.1; 15/26

[58] Field of Search ..... 15/22.1, 23, 25, 15/26

[56] References Cited

U.S. PATENT DOCUMENTS

| | | | |
|---|---|---|---|
| 860,107 | 7/1907 | Reminger | 15/26 |
| 1,120,812 | 12/1914 | Harbian | 15/26 |
| 1,481,891 | 1/1924 | Cruikshank | 15/26 |
| 1,565,479 | 12/1925 | Lorraine et al. | 15/26 |
| 2,160,835 | 6/1939 | Davids | 15/26 |
| 2,660,745 | 12/1953 | Yusko | 15/26 |
| 4,783,869 | 11/1988 | Lee | 15/26 |
| 5,311,630 | 5/1994 | Nakamura et al. | 15/26 |
| 5,813,075 | 9/1998 | Graur | 15/26 |

*Primary Examiner*—Terrence R. Till
*Attorney, Agent, or Firm*—A & J

[57] ABSTRACT

A manually operated toothbrush which will move up and down at the same time when moving to and fro, includes a head provided with bristles at a front end thereof and being cylindrical in shape at a rear end thereof, the rear end having a curved groove formed with a circular recess, an elongated tubular handle having a cylindrical cavity at a front end thereof adapted to receive the rear end of the head, the handle having a circular through hole aligned with the circular recess and a drain hole at a rear end thereof, a compressed spring fitted within the handle, a T-shaped pin having a circular projection at the upper end and a smaller circular protuberance at the lower end, the T-shaped pin extending through the circular through hole of the handle and the curved groove of the head to join the handle and the head together, whereby the toothbrush will move up and down at the same time when the toothbrush is moving to and fro as desired.

1 Claim, 4 Drawing Sheets

TOOTHBRUSH

BACKGROUND OF THE INVENTION

1. Field of the Invention

This invention is related to a toothbrush and in particular to a manually operated toothbrush which will move up and down at the same time when the toothbrush is moving to and fro.

2. Description of the Prior Art

It has been found that the conventional tooth brush is simply a stick with a brush at one end thereof so that one may use it to clean his teeth. However, most of the users do not know the correct way of brushing teeth and only move the toothbrush to and fro in brushing teeth thereby making it impossible to clean the teeth thoroughly.

Therefore, it is an object of the present invention to provide a toothbrush which can automatically turn up and down when it is moved to and fro.

SUMMARY OF THE INVENTION

This invention is related to a toothbrush and in particular to a manually operated toothbrush which will move up and down at the same time when the toothbrush is moving to and fro.

According to a preferred embodiment of the present invention, a manually operated toothbrush which will move up and down at the same time when moving to and fro, includes a head provided with bristles at a front end thereof and being cylindrical in shape at a rear end thereof, the rear end having a curved groove formed with a circular recess, an elongated tubular handle having a cylindrical cavity at a front end thereof adapted to receive the rear end of the head, the handle having a circular through hole aligned with the circular recess and a drain hole at a rear end thereof, a compressed spring fitted within the handle, a T-shaped pin having a circular projection at the upper end and a smaller circular protuberance at the lower end, the T-shaped pin extending through the circular through hole of the handle and the curved groove of the head to join the handle and the head together, whereby the toothbrush will move up and down at the same time when the toothbrush is moving to and fro as desired.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
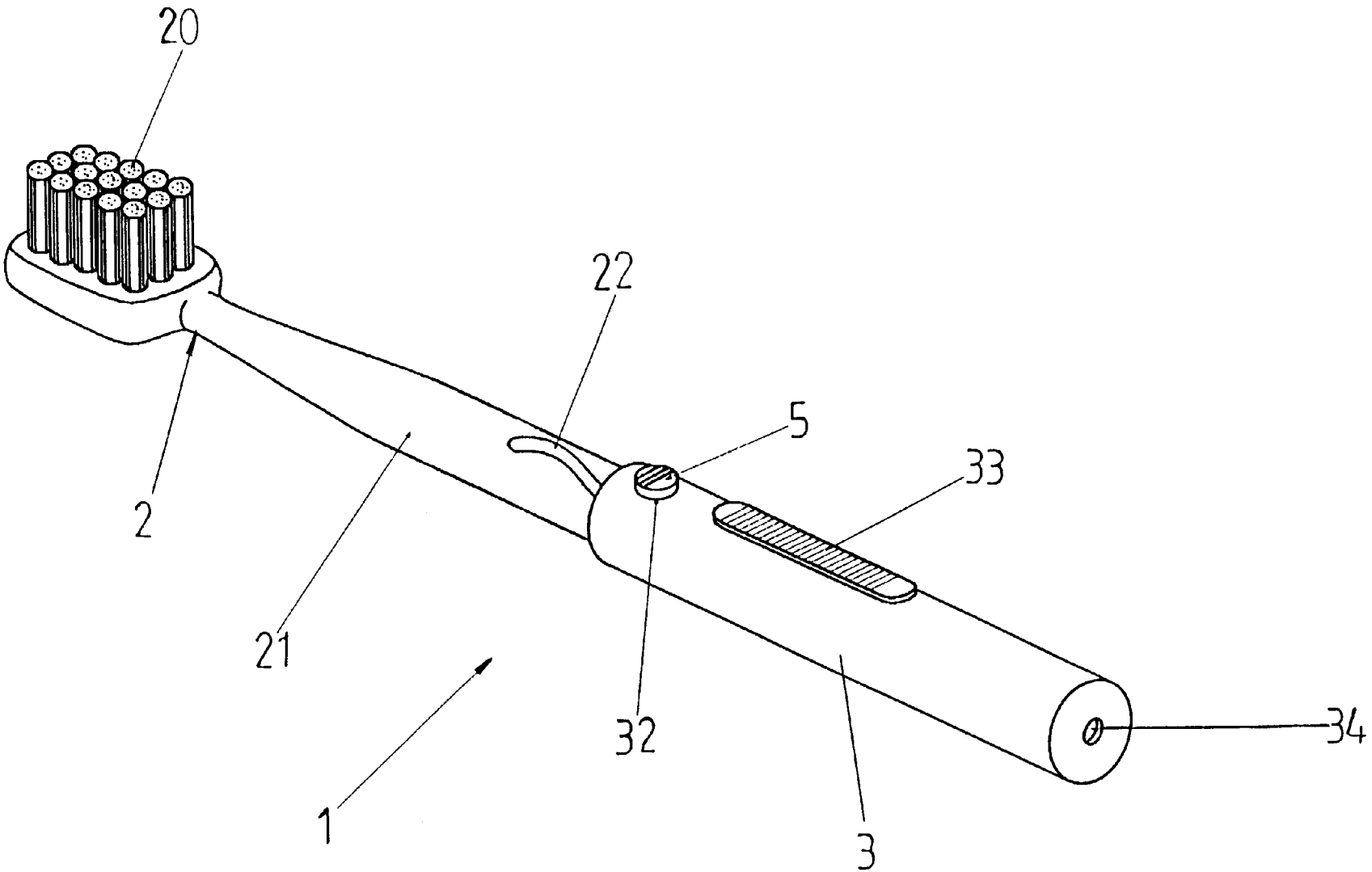
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
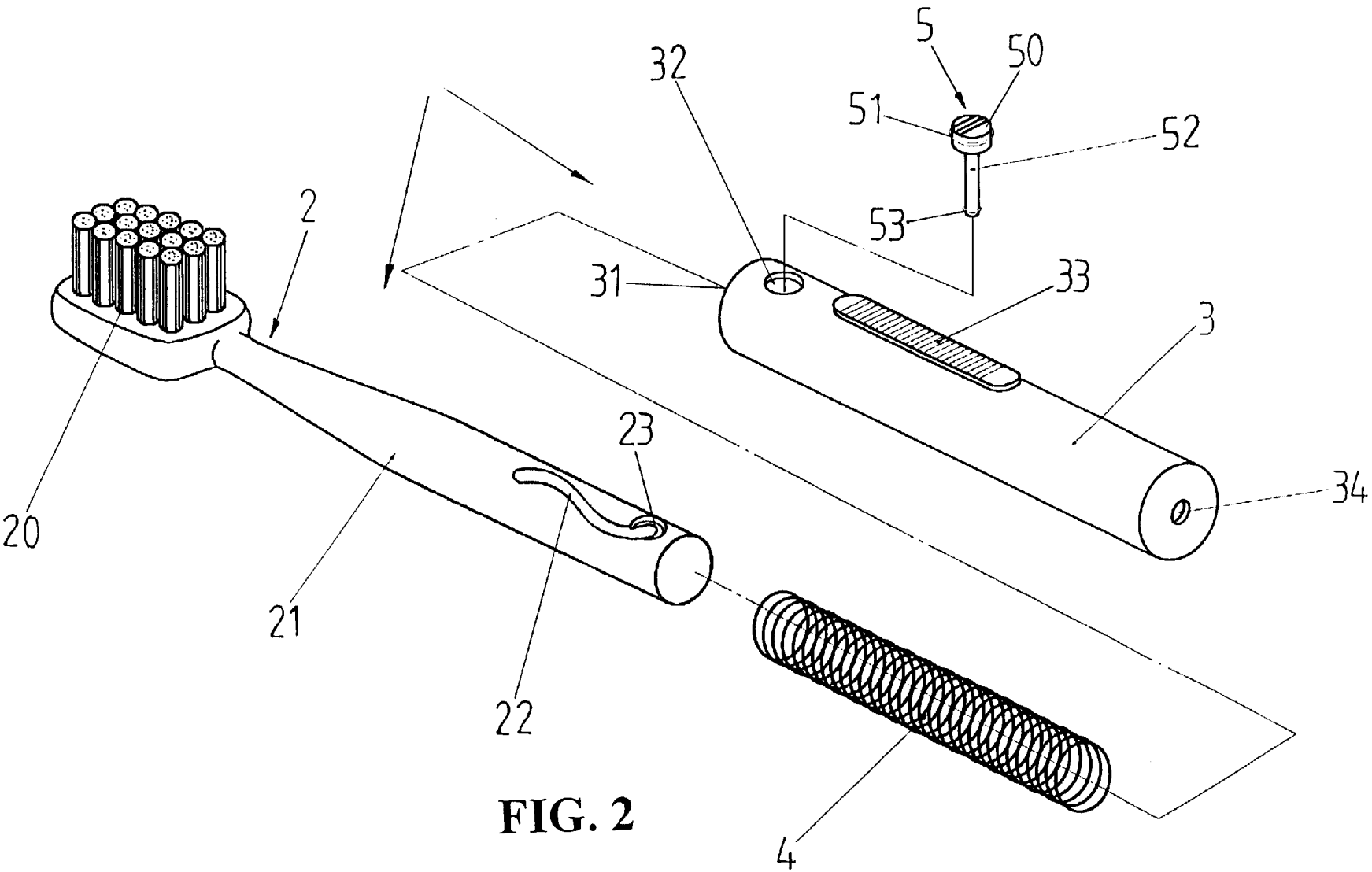
FIG. 2 is an exploded view of the present invention.

With reference to the drawings and in particular to FIGS. 1 and 2 thereof, the toothbrush 1 according to the present invention generally comprises a head 2, a handle 3, a compressed spring 4 and a pin 5.

The head 2 is provided with bristles 20 for brushing teeth at the front end thereof The rear end 21 of the head 2 is cylindrical in shape and has a curved groove 22 formed with a circular recess 23 at the outer end thereof.

The handle 3 is an elongated tubular member having a cylindrical cavity 31 at the front end thereof adapted to receive the rear end 21 of the head 2 (see FIG. 3). The handle 3 has a circular through hole 32 aligned with the circular recess 23 of the head 2 and a drain hole 34 at the rear end thereof.

The compressed spring 4 is fitted within the cavity 31 of the handle 3.

Figure 3A:
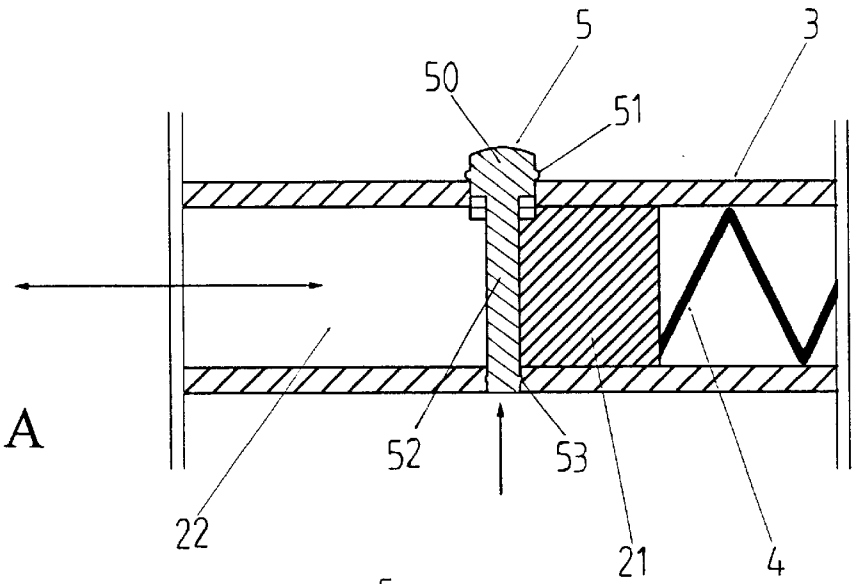
FIG. 3A illustrates how to adjust the pin to cause the head to rotate with the handle simultaneously.
Figure 3B:
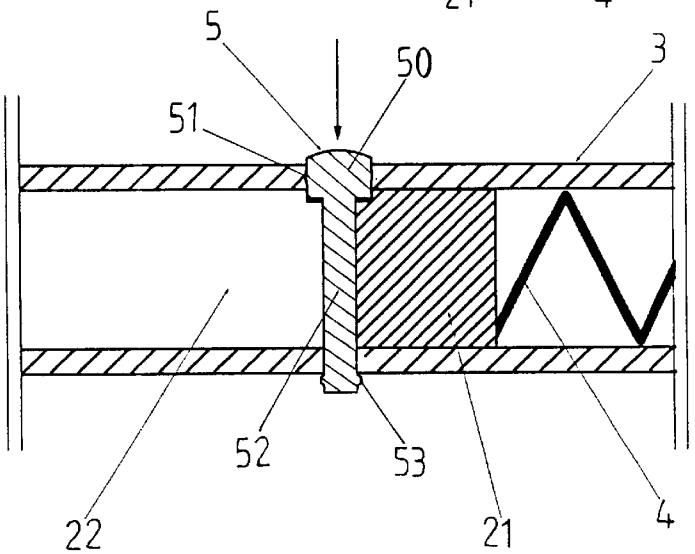
FIG. 3B illustrates how to adjust the pin to enable the head to turn up and down respect to the handle.

The pin 5 is a T-shaped element having an enlarged cap 50 at the upper end formed with a circular protuberance 51 (see FIGS. 3A and 3B). A rod 52 extends downwardly from the enlarged cap 50 and has a smaller circular protuberance 53 at the lower end. The pin 5 extends through the circular through hole 32 of the handle 3 and the curved groove 22 of the head 2 to join the handle 3 and the head 2 together.

In assembly, the compressed spring 4 is first disposed within the cavity 31 of the handle 3 and then the head 2 with bristles 20 is fitted in the handle 2. Thereafter, the T-shaped pin 5 is inserted into the circular through hole 32 of the handle 3 and the curved groove 22 of the head 2, so that the circular protuberance 51 at the upper end of the pin is disposed above the circular through hole 32 of the handle 3 and the circular protuberance 53 at the lower end of the pin 5 is engaged with the lower end of the through hole 32 of the handle 3 thereby preventing the pin 5 from shaking. When a user moves the toothbrush 1, the head 2 will be gradually forced into the handle 3 along the curved groove 22 thereby causing the head 2 to turn up and down. When the head 2 is moved into the handle 3 to the farthest extent, the compressed spring 4 will force the head 2 to go back thus also causing the head 2 to turn up and down. When not desired to have the head 2 to turn up and down, it is only necessary to depress the T-shaped pin 5 to engage the circular protuberance 51 with the circular recess 23 of the head 2 hence fixedly joining the head 2 and the handle 3 together (see FIG. 3B).

Figures 4A, 4B, 4C:
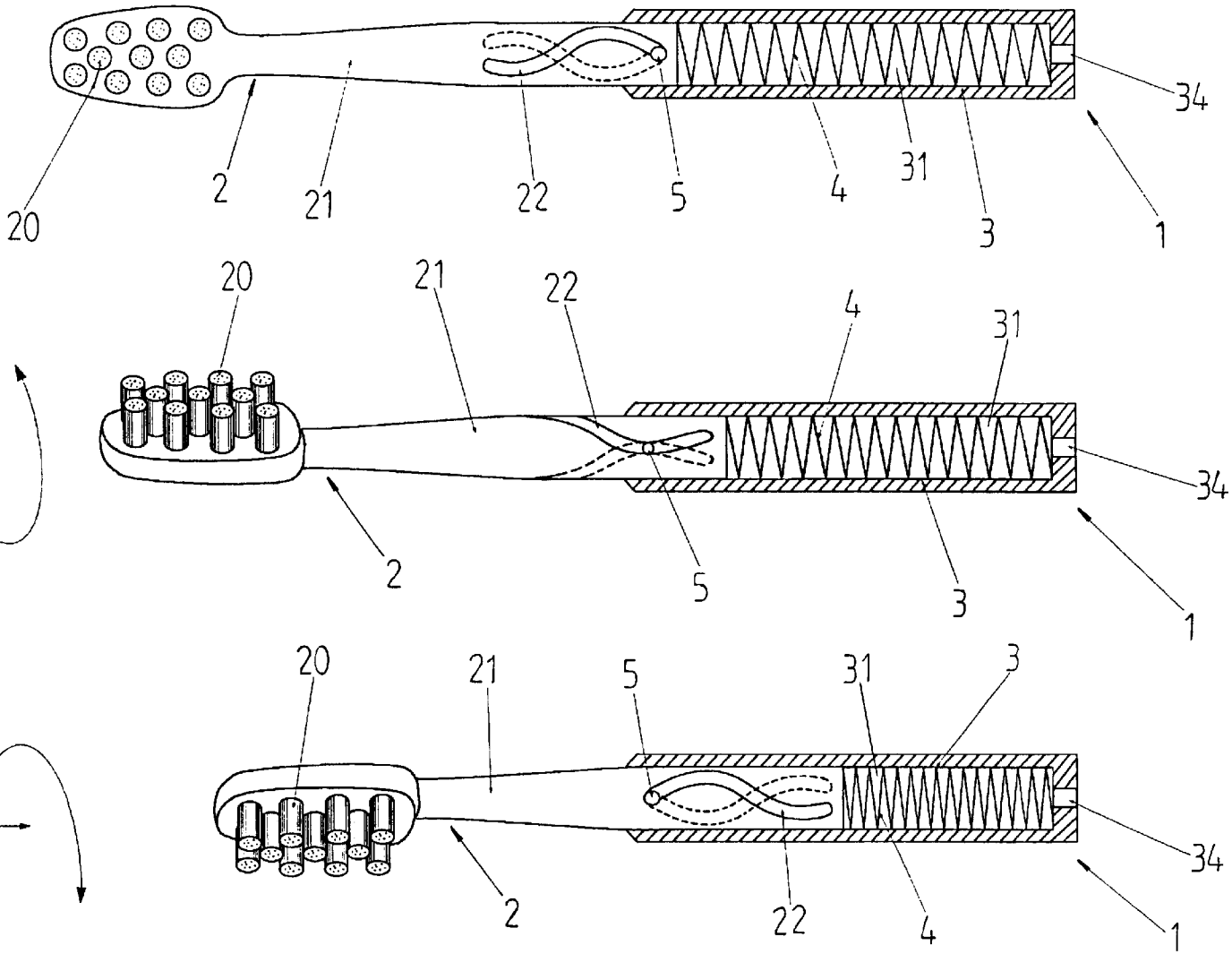
FIGS. 4A, 4B and 4C illustrate the working principle of the present invention.

FIGS. 4A, 4B and 4C illustrate the working principle of the present invention. As shown in FIG. 4A, when no external force is applied to the toothbrush 1, the compressed spring 4 is disposed within the cavity 31 of the handle 3, the head 2 is fitted in the handle 2, and the T-shaped pin 5 is inserted into the circular through hole 32 of the handle 3 and the curved groove 22 of the head 2 with the circular protuberance 51 disposed above the circular hole 32 of the handle 3 (see FIG. 3A). As shown in FIG. 4B, when a user moves the toothbrush 1, the head 2 will be gradually forced into the handle 3 along the curved groove 22 thereby causing the head 2 to turn up and down, and when the head 2 is moved into the handle 3 to the farthest extent, the compressed spring 4 will force the head 2 to go back thus also causing the head 2 to turn up and down. As shown in FIG. 4C, when not desired to have the head 2 to turn up and down, it is only necessary to depress the T-shaped pin 5 to engage the circular protuberance 51 with the circular recess 23 of the head 2 hence fixedly joining the head 2 and the handle 3 together (see also FIG. 3B), It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A manually operated toothbrush which will move up and down at the same time when moving to and fro, comprising:

a head provided with bristles at a front end thereof and being cylindrical in shape at a rear end thereof, said rear end having a curved groove formed with a circular recess;

an elongated tubular handle having a cylindrical cavity at a front end thereof adapted to receive said rear end of said head, said handle having a circular through hole aligned with said circular recess and a drain hole at a rear end thereof;

a compressed spring fitted within said handle;

a T-shaped pin having a circular projection at the upper end and a smaller circular protuberance at the lower end, said T-shaped pin extending through said circular through hole of said handle and said curved groove of said head to join said handle and said head together;

wherein said compressed spring is disposed within said handle, said head is fitted in said handle, and said T-shaped pin is inserted into said circular through hole of said handle and said curved groove of said head with said smaller circular protuberance engaged with a lower portion of said circular through hole of said handle thereby keeping said T-shaped pin at a fixed position;

whereby when a user moves said toothbrush to and fro, said head will be gradually forced into said handle along said curved groove thereby causing said head to move up and down, and when said head is moved into said handle to the farthest extent, said compressed spring will force said head to go back thus causing said head to move up and down, and when it is not desired to have said head to move up and down, it is only necessary to depress said T-shaped pin to engage said circular projection with said circular recess of said head hence fixedly joining said head to said handle.

* * * * *